US011713665B2

(12) United States Patent
Harvey et al.

(10) Patent No.: US 11,713,665 B2
(45) Date of Patent: Aug. 1, 2023

(54) SYSTEMS, METHODS, AND DEVICES FOR DIRECTIONALLY DRILLING AN OIL WELL WHILE ROTATING INCLUDING REMOTELY CONTROLLING DRILLING EQUIPMENT

(71) Applicant: General Downhole Tools, Ltd., Calgary (CA)

(72) Inventors: Michael Harvey, Calgary (CA); David Devlin, Calgary (CA); Vladimir Jorgic, Calgary (CA)

(73) Assignee: GENERAL DOWNHOLE TOOLS, LTD., Calgary (CA)

( * ) Notice: Subject to any disclaimer, the term of this patent is extended or adjusted under 35 U.S.C. 154(b) by 0 days.

(21) Appl. No.: 16/870,835

(22) Filed: May 8, 2020

(65) Prior Publication Data

US 2020/0355056 A1 Nov. 12, 2020

Related U.S. Application Data

(60) Provisional application No. 62/845,043, filed on May 8, 2019, provisional application No. 62/845,048, filed on May 8, 2019.

(51) Int. Cl.
*E21B 21/10* (2006.01)
*E21B 23/01* (2006.01)
(Continued)

(52) U.S. Cl.
CPC ..... *E21B 44/00* (2013.01); *E21B 7/062* (2013.01); *E21B 21/103* (2013.01); *E21B 23/01* (2013.01);
(Continued)

(58) Field of Classification Search
CPC ..... E21B 21/103; E21B 2200/04; E21B 2200/06; E21B 23/01; E21B 44/00;
(Continued)

(56) References Cited

U.S. PATENT DOCUMENTS 7,999,695 B2 * 8/2011 Rodney ..... E21B 47/12 340/855.5
9,945,204 B2 * 4/2018 Ross ..... E21B 34/12
(Continued)

FOREIGN PATENT DOCUMENTS

WO WO-2020223825 A1 * 11/2020 ..... E21B 47/00

*Primary Examiner* — Daniel P Stephenson
(74) *Attorney, Agent, or Firm* — Dickinson Wright PLLC

(57) ABSTRACT

Methods, systems, and storage media are presented for operating a drill string within a well. Exemplary implementations may: detect, using one or more sensors, data representing an analog control command sequence; analyze the analog control command sequence; determine that the control command sequence represents a command to change an operational mode of the drill string from a first operational mode to a second operational mode; and transmit a signal to an actuator of the drill string, the signal representing an electronic command to activate the actuator in such a way as to change the drill string from the first operational mode to the second operational mode. In some embodiments, the analog control sequence may comprise a predetermined sequence of rotational inputs, vibrational inputs, pressure inputs, or a combination thereof.

23 Claims, 10 Drawing Sheets

(51) Int. Cl.
*E21B 44/00* (2006.01)
*E21B 47/00* (2012.01)
*E21B 7/06* (2006.01)

(52) U.S. Cl.
CPC ..... *E21B 47/00* (2013.01); *E21B 2200/04* (2020.05); *E21B 2200/06* (2020.05)

(58) Field of Classification Search
CPC ..... E21B 47/00; E21B 7/062; E21B 17/02; E21B 17/04; E21B 34/066; E21B 47/18
See application file for complete search history.

(56) References Cited

U.S. PATENT DOCUMENTS

| | | | | |
|---|---|---|---|---|
| 10,273,753 | B2 * | 4/2019 | Marland | E21B 17/04 |
| 2011/0284292 | A1 * | 11/2011 | Gibb | E21B 7/06 175/61 |
| 2016/0138381 | A1 * | 5/2016 | Logan | E21B 47/12 175/24 |
| 2019/0048702 | A1 * | 2/2019 | Vorhoff | E21B 7/06 |
| 2020/0355056 | A1 * | 11/2020 | Harvey | E21B 17/04 |

* cited by examiner

SYSTEMS, METHODS, AND DEVICES FOR DIRECTIONALLY DRILLING AN OIL WELL WHILE ROTATING INCLUDING REMOTELY CONTROLLING DRILLING EQUIPMENT

CROSS-REFERENCE TO RELATED APPLICATIONS

The present application claims priority to U.S. Provisional Patent Application Nos. 62/845,043 and 62/845,048, both filed May 8, 2019, the contents of which are incorporated by reference herein in their entirety.

TECHNICAL FIELD

This disclosure relates generally to technological improvements in the field of downhole tools used in well drilling and, in particular, to systems, methods and apparatuses for controlling mode-switchable downhole tools.

BACKGROUND

Conventional means of performing work in an oil or gas well includes drilling while pumping drilling fluid through a pipe or drill string to a drill bit that is cutting a hole in an earthen formation. Ground-up rock cuttings are flushed out of the wellbore with drilling fluid or "mud" that is pumped down through the center of the drill string from the surface. The mud flows out through the bit and pushes the cuttings up the annulus of the wellbore to the surface, where the fluid can be cleaned and re-circulated. Occasionally, there is a need to stop drilling and perform other functions in the well, such as hole cleaning and friction-breaking. However, those activities typically require the drill bit to continue to rotate with the drill string, which can be disadvantageous under some circumstances.

Drilling fluid is also used to lubricate and cool the drilling tools and as a medium for the placement of lost circulation materials ("LCM"). Because of the various functions of the drilling fluid, it is sometimes advantageous to create a different flow rate at other parts of the annulus than is present at the very bottom of the hole near the bit. Or, for example, if LCM is being placed at a particular section of the wellbore, it may be desirable to have the capability to pump LCM in to the annulus without interference from the large particles usually carried to the surface by the drilling fluid. Therefore, a drilling tool with a vent to the annulus that could be opened or closed is desirable.

Conventionally a subassembly or other tool may be used that changes flow mode in response to balls of various sizes being pumped into the tool from the surface. Such tools operate by having the dropped ball sit in an orifice seat and using the pump pressure to shift sleeves that open and close ports, allowing or blocking flow from exiting the side of the tool. Such tools are usually strictly mechanical in nature, containing no electronic components. A disadvantage of relying on this style of tool is that they can only be operated in this manner a few times (usually fewer than 10) before they become filled with balls. Further, because the tools require pump pressure to operate, the sealing means must be moved into and out of position under pressure—a process which can damage seals, leaving them more failure prone.

Another common limitations of conventional drilling tools become apparent in long and highly inclined wellbores, wherein the ability of the mud to adequately transport he cuttings to the surface is commonly insufficient. In these wells, there is often a tendency for the cuttings and solids to accumulate at the bottom of the wellbore and to form drifts or "cutting beds." These cutting beds cause several problems, including increased circulating pressure, sticking of the drill string on the side of the bottom hole assembly ("BHA"), added friction, and other problems when running casing or performing other completion operations.

A known method of increasing the efficiency of hole cleaning by the circulating mud is to stir up the cutting beds along the well path by rotating the drill string at a very high RPM (often more than 100 RPM) The boundary layer friction of the drilling fluid next to the drill pipe induces a rotation aspect to the drilling fluid. At a high enough RPM, this can transition the flow characteristics from laminar to turbulent, promoting the pulling of cuttings into the flow stream from their beds.

Unfortunately, most bottom hole equipment used to drill such long lateral wells carries rotational speed restrictions that prevent the use of high-RPM hole cleaning methods. In addition to the rotational limits on mud motors, it is conventionally accepted that longevity of all elements of the BHA can be materially improved by avoiding high rotational speeds. Therefore there is a need for a tool including a selectively engageable clutch that will allow for turning the drill string above the BHA at high rotational speeds without stressing the BHA. In addition to the clutch described above, an anchor subassembly may be employed, which engages the wellbore, preventing rotation by reactive torque, while allowing for axial movement. When used with the clutch, drill string components above the BHA or a swivel may rotate freely. Preventing the BHA from rotation while allowing it to move axially creates the ability to hold the drill bit toolface constant in order to directionally steer the BHA, either for drilling new wellbore, or sidetracking an additional wellbore. Allowing the drill string above the clutch to rotate improves general hole cleaning and increases the axial force up and down on the top of the anchored BHA, while the anchored BHA is non-rotating.

The present disclosure describes methods and systems for sending analog control signals from the surface to electronics inside a drilling tool within a wellbore. With the control capabilities described herein, new types of tools can be designed and deployed to solve many problems of traditional drilling tools—including those discussed above—and to add new functionality beyond conventional tools.

SUMMARY

In general, the present disclosure provides systems, methods, and apparatuses for controlling mode-switchable downhole tools. One aspect of the present disclosure relates to a method of operating a drill string within a well, the method including sending analog control signals to a drilling tool, for example using rotational inputs, vibration, or pressure. A method of operating a drill string within a well may comprise receiving data from one or more sensors of the drill string, the data representing an analog control command sequence. The method may further comprise analyzing the analog control command sequence. The method may further comprise determining that the control command sequence represents a command to change an operational mode of a drill string from a first operational mode to a second operational mode. The method may further comprise transmitting a signal to an actuator of the drill string, the signal representing an electronic command to activate the actuator in such a way as to change the drill string from the first operational mode to the second operational mode.

In some implementations of the method, the analog control sequence comprises a predetermined sequence of rotational inputs to the drill string. In some implementations of the method, the analog control sequence comprises a predetermined sequence of vibrational inputs to the drill string. In some implementations, the predetermined sequence of vibrational inputs may comprise actuations of at least one pump associated with the downhole device.

In some implementations of the method, the drill string may further comprise: a substantially cylindrical body comprising a plurality of segments; an anchoring subassembly segment comprising one or more retractable anchors, wherein the actuator comprises an electronic driver that, when the drill string is in the second operational mode, activates an internal mechanism of the drill string to force the retractable anchors of the anchoring subassembly outward to contact a wall of the well such that rotational motion of the anchoring subassembly is inhibited while axial movement of the anchoring subassembly segment is not prevented. In some implementations, a clutch assembly may be configured to allow for rotation of the drill string above the anchoring subassembly when the drill string is in the second operational mode.

In some implementations of the method, the drill string may further comprise a first and second tubular member, the first and second tubular members at least partially nested within each other and each of the first and second tubular members having a threaded connection at its distal end; and an axially moveable cylindrical sleeve disposed laterally between the first and second tubular members, wherein: the cylindrical sleeve is rotationally coupled to the first tubular member; the actuator comprises an electric motor configured to cause axial movement of the cylindrical sleeve when activated; when the drill string is in the first operational mode, the cylindrical sleeve is rotationally coupled to the second tubular member; and when the drill string is in the second operational mode, the cylindrical sleeve is rotationally decoupled from the second tubular member.

In some implementations of the method, the drill string may further comprise a substantially cylindrical body comprising a plurality of segments; a circulating subassembly segment comprising a bottom aperture at the distal end of the circulating subassembly and one or more annulus apertures in the side wall of the circulating subassembly; and a hollow cylindrical sleeve positioned within the circulating subassembly, wherein the actuator comprises an electric motor configured to cause axial movement of the cylindrical sleeve when activated; when the drill string is in the first operational mode, the cylindrical sleeve is positioned such that the one or more annulus apertures are blocked and a fluid may flow through the bottom aperture, which is not blocked; and when the drill string is in the second operational mode, the cylindrical sleeve is positioned such that the fluid may flow through both the one or more annulus apertures and the bottom aperture.

Some implementations of the method may further include a third operational mode of the drill string, wherein a ball valve is configured to inhibit the fluid from flowing through the bottom aperture while the cylindrical sleeve is positioned to allow the fluid to flow through the one or more annulus apertures.

Another aspect of the present disclosure relates to a system comprising a drill string and, according to some implementations of the system, one or more hardware processors configured by machine-readable instructions to: receive data from one or more sensors of the drill string, the data representing an analog control command sequence; analyze the analog control command sequence; determine that the control command sequence represents a command to change an operational mode of the drill string from a first operational mode to a second operational mode; and transmit a signal to an actuator of the drill string, the signal representing an electronic command to activate the actuator in such a way as to change the drill string from the first operational mode to the second operational mode.

In some implementations of the system, the analog control sequence may comprise a predetermined sequence of rotational inputs to the drill string. In some implementations of the system, the analog control sequence may comprise a predetermined sequence of vibrational inputs to the drill string. According to some implementations of the system, the predetermined sequence of vibrational inputs may comprise actuations of at least one pump associated with the downhole device.

According to some implementations of the system, the drill string may further comprise: a substantially cylindrical body comprising a plurality of segments; and an anchoring subassembly segment comprising one or more retractable anchors; wherein the actuator comprises an electronic driver that, when the drill string is in the second operational mode, activates an internal mechanism of the drill string to force the retractable anchors of the anchoring subassembly outward to contact a wall of the well such that rotational motion of the anchoring subassembly is inhibited while axial movement of the anchoring subassembly segment is not prevented.

Some implementations of the system may further comprise a clutch assembly configured to allow for rotation of the drill string above the anchoring subassembly when the drill string is in the second operational mode. In some implementations of the system of claim 10, the drill string may further comprise: a first and second tubular member, the first and second tubular members at least partially nested within each other and each of the first and second tubular members having a threaded connection at its distal end; and an axially moveable cylindrical sleeve disposed laterally between the first and second tubular members wherein: the cylindrical sleeve is rotationally coupled to the first tubular member; the actuator comprises an electric motor configured to cause axial movement of the cylindrical sleeve when activated; when the drill string is in the first operational mode, the cylindrical sleeve is rotationally coupled to the second tubular member; and when the drill string is in the second operational mode, the cylindrical sleeve is rotationally decoupled from the second tubular member.

Some implementations of the system may further comprise a substantially cylindrical body comprising a plurality of segments; a circulating subassembly segment comprising a bottom aperture at the distal end of the circulating subassembly and one or more annulus apertures in the side wall of the circulating subassembly; and a hollow cylindrical sleeve positioned within the circulating subassembly, wherein: the actuator comprises an electric motor configured to cause axial movement of the cylindrical sleeve when activated; when the drill string is in the first operational mode, the cylindrical sleeve is positioned such that the one or more annulus apertures are blocked and a fluid may flow through the bottom aperture, which is not blocked; and when the drill string is in the second operational mode, the cylindrical sleeve is positioned such that the fluid may flow through both the one or more annulus apertures and the bottom aperture.

Some implementations of the system may further comprise a third operational mode of the drill string, wherein a ball valve is configured to inhibit the fluid from flowing through the bottom aperture while the cylindrical sleeve is positioned to allow the fluid to flow through the one or more annulus apertures.

Yet another aspect of the present invention relates to a non-transient computer-readable storage medium having instructions stored thereon, the instructions being executable by one or more processors to perform a method for operating a drill string within a well, the method comprising: receiving data from one or more sensors of the drill string, the data representing an analog control command sequence; analyzing the analog control command sequence; determining that the control command sequence represents a command to change an operational mode of a drill string from a first operational mode to a second operational mode; and transmitting a signal to an actuator of the drill string, the signal representing an electronic command to activate the actuator in such a way as to change the drill string from the first operational mode to the second operational mode.

In some implementations of the non-transient, computer-readable storage medium, the analog control sequence comprises a predetermined sequence of rotational inputs to the drill string.

Other technical features may be readily apparent to one skilled in the art from the following figures, descriptions, and claims. These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), solid state drives (SSDs), flash, or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

Embodiments of methods and systems for operating a drill string within a well are presented. FIGS. 1 through 9C, discussed below, and the various embodiments used to describe the principles of this disclosure are by way of illustration only and should not be construed in any way to limit the scope of the disclosure.

Figure 1:
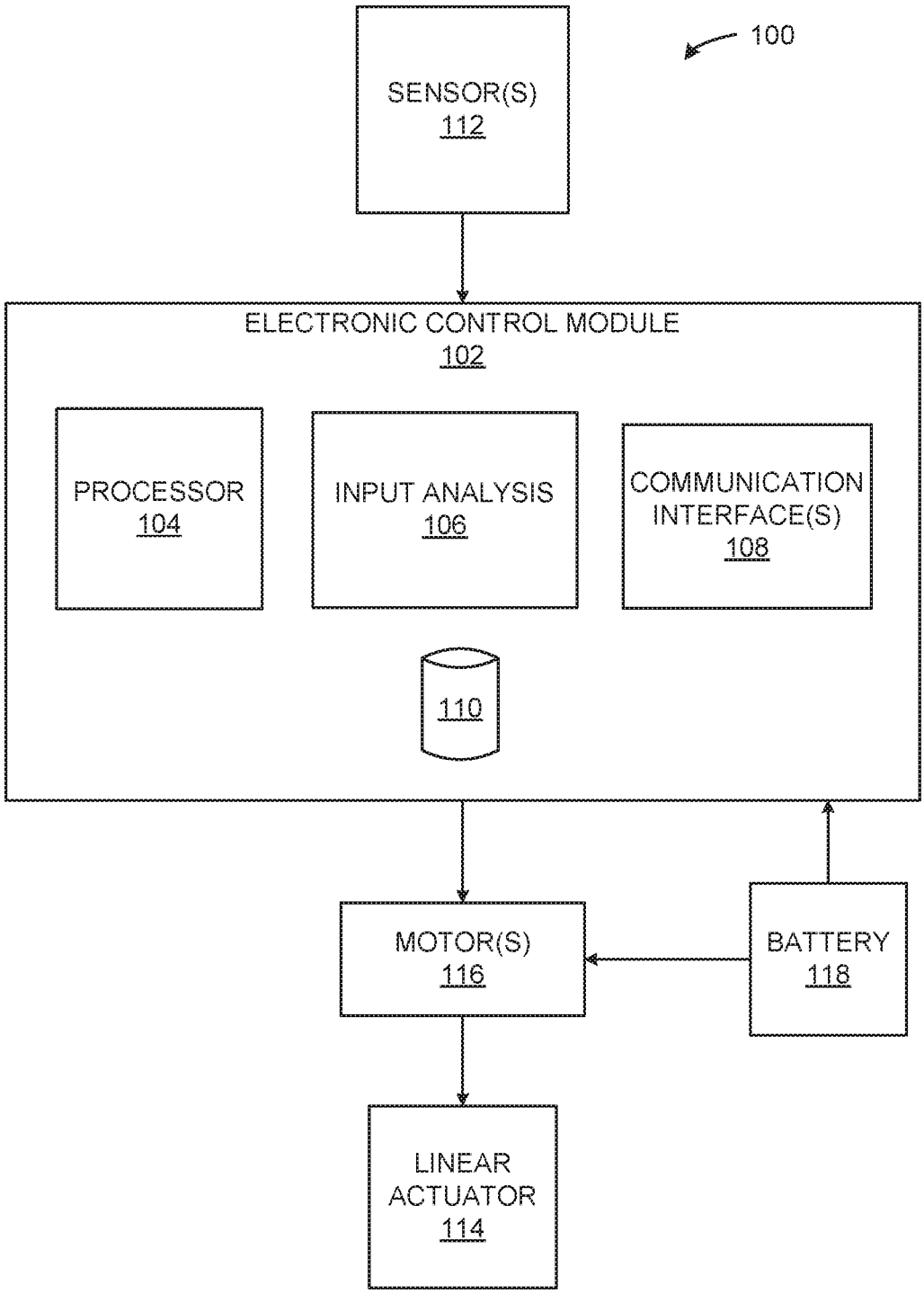
FIG. 1 illustrates a high-level component diagram of an electronic control module according to some embodiments of this disclosure.

FIG. 1 illustrates a high-level component diagram of an electronic control module according to some embodiments of this disclosure. According to some embodiments, electronic control module ("ECM") 102 may be positioned within a drill string—for example located within a subassembly of the drill string. According to some embodiments, ECM 102 may include one or more processors 104, one or more memories 110, an input analysis module 106, and one or more communication interfaces 108.

According to some embodiments, the one or more processors 104 may include one or more of a microprocessing unit ("MPU"), and application-specific integrated circuit, or another type of computing processor. Accordingly, in some embodiments, communication and/or memory functions of elements 108 and 110, for example, may be integrated into processor 104.

According to some embodiments, one or more sensors 112 may detect events or conditions, and pass this data to ECM 102. In some embodiments, sensors 112 may include one or more of micro-electromechanical system ("MEMS") gyroscopes, accelerometers, temperature sensors, pressure sensors, impact sensors, or other suitable vibration or motion sensors. In some embodiments, sensors 112 may send data to ECM control module 102 via communication interface 108. One of ordinary skill in the art will recognize numerous other known an valid ways of transmitting such data.

In some embodiments, when ECM 102 receives sensor data from sensors 112, it attempts to interpret the input data using input analysis module, 106. According to some embodiments, one or more predefined control input sequences may be available to ECM 102, for example by having been stored in memory 110 by a manufacturer or operator of a drill string or subassembly containing ECM 102. In some embodiments, control input sequences may be modified using a user interface (not shown at FIG. 1).

Input commands may be made in various ways, according to some embodiments. For example, rotational inputs of the drill string, vibration inputs of the drill string, or pressure inputs of the drill string. According to some embodiments, an example rotational input command sequence may be represented as follows:

1. The drill string is held still for longer than two minutes.
2. Rotation is turned on for between 25 and 35 seconds.
3. Rotation is stopped.
4. Rotation begins again between 25 and 35 seconds later (for operational mode 1) OR
5. Rotation begins again between 55 and 65 second later (for operational mode 2)

In some embodiments, a third or more additional operational modes may be defined, for example by using different timing. The input sequences may be defined or altered according to some embodiments in response to particular circumstances of a drilling project.

According to some embodiments, an example vibrational input command sequence may be represented as follows:

1. The drill string fluid pumps are turned off for greater than two minutes.
2. The pumps are turned on for between 25 and 35 seconds.
3. The pumps are turned off.
4. The pumps are turned back on between 25 and 35 seconds later (for operational mode 1) OR
5. The pumps are turned back on between 55 and 65 seconds later (for operational mode 2).

In some embodiments, a third or more additional operational modes may be defined, for example by using different timing. The input sequences may be defined or altered according to some embodiments in response to particular circumstances of a drilling project.

According to some embodiments, when input analysis module 106 identifies a valid control input sequence, ECM may send an electronic signal to a linear actuator 114 to cause a physical movement using the linear actuator and/or motors 116, all contained within the drill string. According to some embodiments, a battery 118 may provide power to various components of the system including the sensors, ECM, linear actuator, and motors.

Figure 2:
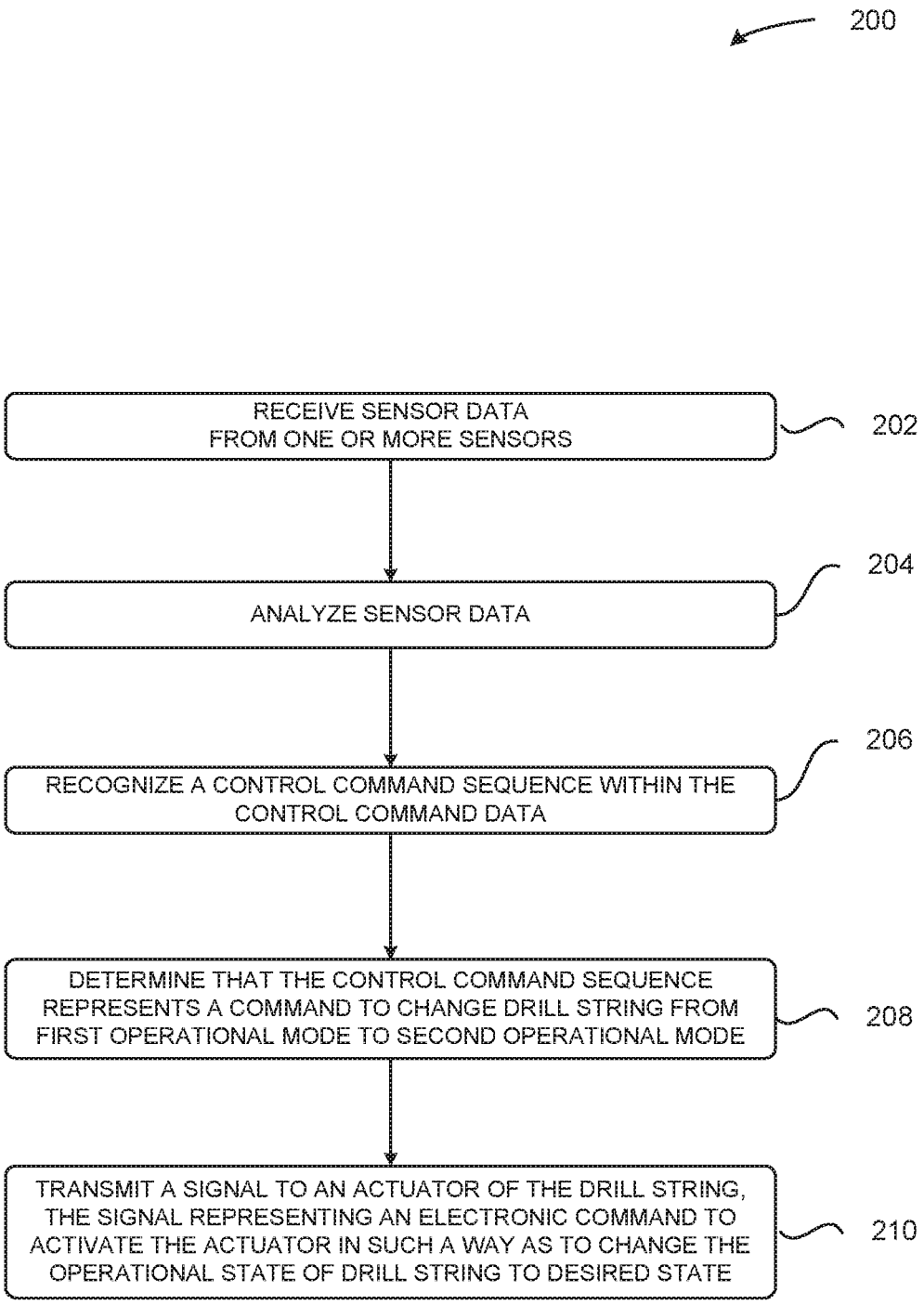
FIG. 2 represents a flowchart for a method of controlling a drill string according to some embodiments of this disclosure.

FIG. 2 represents a flowchart for a method of controlling a drill string according to some embodiments of this disclosure. At step 202, data is received from one or more sensors. According to some embodiments, this data may be received at an electronic control module such as ECM 102 of FIG. 1.

At step 204, according to some embodiments, the sensor data is analyzed, for example by an input analysis module similar to input analysis module 106 of FIG. 1. At step 206, according to some embodiments, a control command sequence is recognized within the control data.

At step 208, according to some embodiments, a determination is made that the recognized control command sequence represents a command to change the drill string and/or a submodule of the drill string from a first operational mode to a second operational mode.

At step 210, according to some embodiments, a signal may be transmitted to an actuator of the drill string, for example a linear actuator 114 as described at FIG. 1. According to some embodiments, a motor may additionally be controlled in order to effect the desired change of operational mode.

Figure 3:
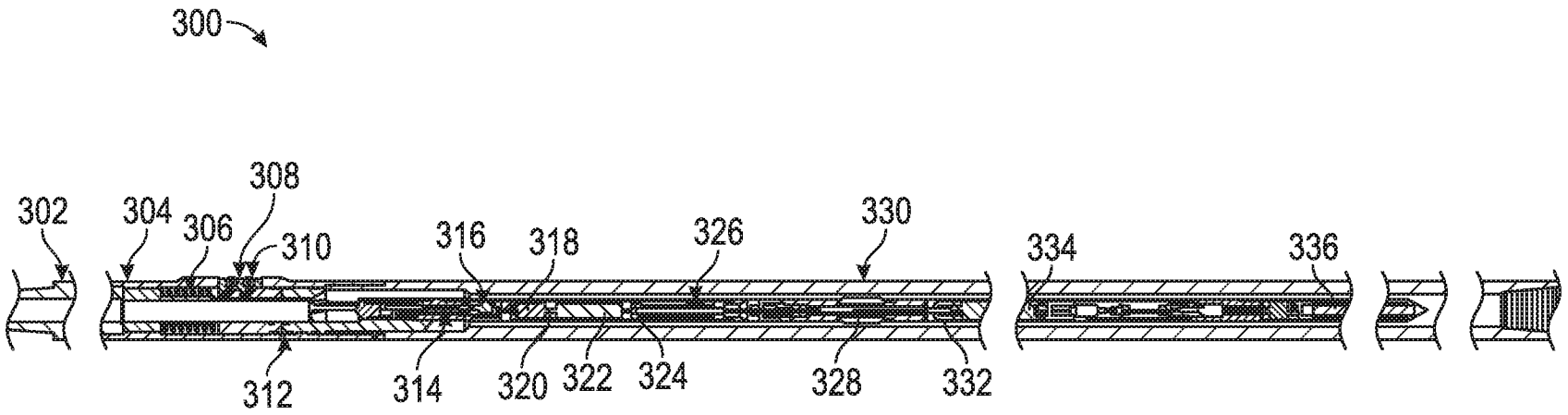
FIG. 3 is a sectional view of a drill string including an anchor subsection device according to some embodiments of this disclosure.

FIG. 3 is a sectional view of a drill string 300 including an anchor subsection according to some embodiments of this disclosure. According to various embodiments, the anchor subsection tool may include a bottom sub 302, an arm sub 304, a return spring 306, one or more arms 308, one or more rollers 310, and an oil pressure section 312 configured to drive arms out and prevent rotary movement while allowing axial movement when the anchor subsection is in an anchored mode of operation.

According to various embodiments, drill string 300 may further include a manifold 314, electronic return valve 316, oil pump 318, a first oil-filled section 320, a motor 322, a second oil-filled section 324, a compensation piston 326, a centralizer 328, a top sub 330, a vibration damper 332, an electronic driver 334, and a battery 336.

According to various embodiments, the anchor subsection may be designed to be switched on and off using rotary, vibration, flow, or pressure commands, or a combination thereof. According to various embodiments, when a command is received to activate anchor mode, arms 308 are pushed out and provide pressure and friction at the well bore wall.

According to various embodiments, during anchor mode, a clutch above the anchor subsection may be set to rotary mode, allowing the drill string to rotate above the anchor sub. According to some embodiments, directional drilling of the drill string may be achieved in this formation with full rotation of the drill string above the BHA while the mud motor and measurement-while-drilling ("MWD") device maintain toolface orientation with the anchor sub. According to some embodiments, the anchor sub holds the reactive torque created by a mud motor and the motor is set to the direction the well is intended to follow.

Figure 4A:
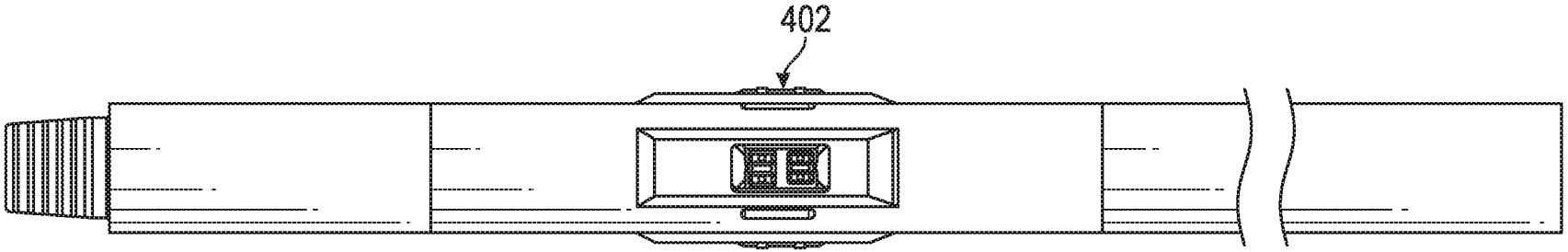
FIGS. 4A and 4B are isometric side views of an anchor subsection tool according to some embodiments of this disclosure.
Figure 4B:
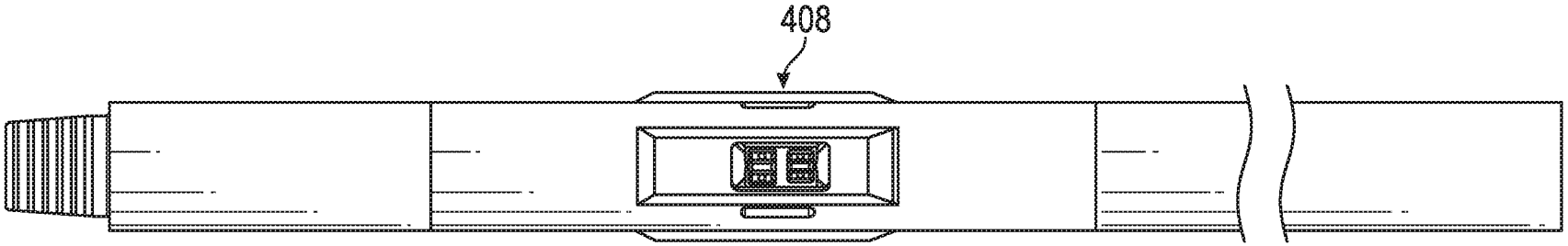

FIGS. 4A and 4B are isometric side views of an anchor subsection tool according to some embodiments of this disclosure. Arms 402 show the arms in a deployed ("anchor") position according to some embodiments. Arms 408 show the arms in a retracted ("drill") position according to some embodiments.

Figure 4C:
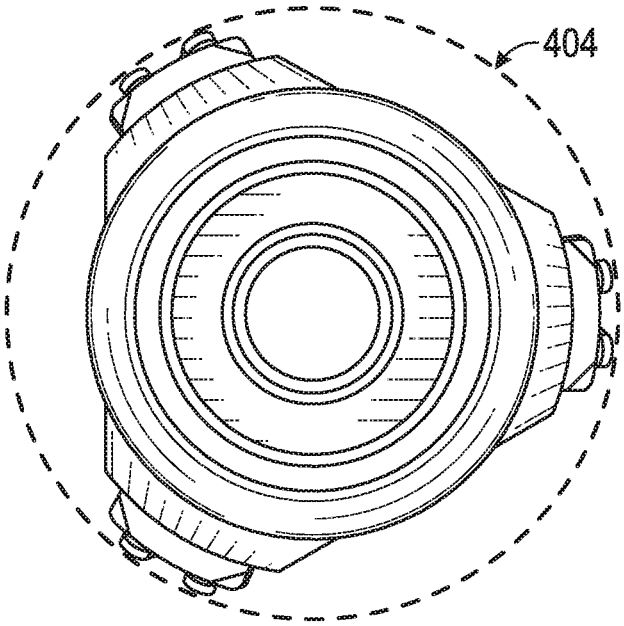
FIGS. 4C and 4D are end views of an anchor subsection tool according to some embodiments of this disclosure.
Figure 4D:
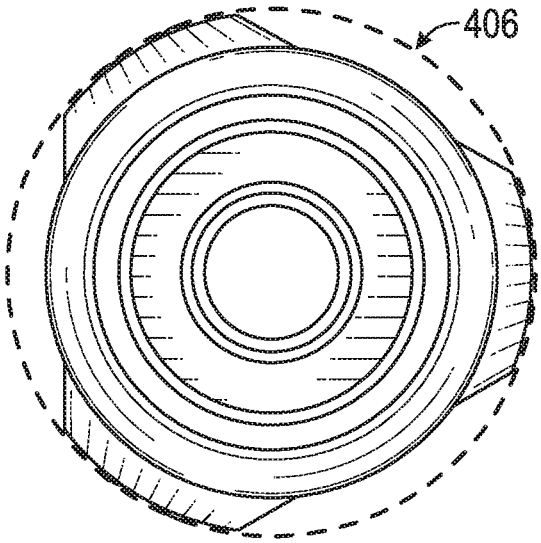

FIGS. 4C and 4D are end views of an anchor subsection tool according to some embodiments of this disclosure. Configuration 404 is an end view of the anchor subsection showing the arms in a deployed ("anchor") position according to some embodiments. Configuration 406 is an end view of the anchor subsection showing the arms in a retracted ("drill") position according to some embodiments. In this example, there are three arm elements 120 degrees from each other.

Figure 5A:
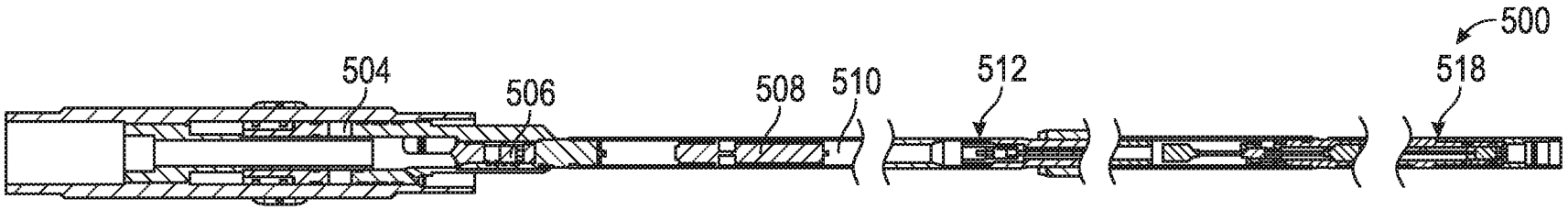
FIGS. 5A-5C are a sectional side view, an isometric side view, and an end view, respectively, of an anchor subsection tool according to some embodiments of this disclosure.
Figure 5C:
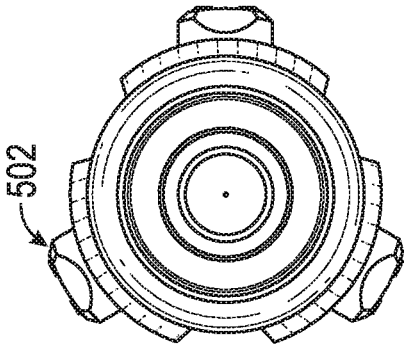
Figure 5B:
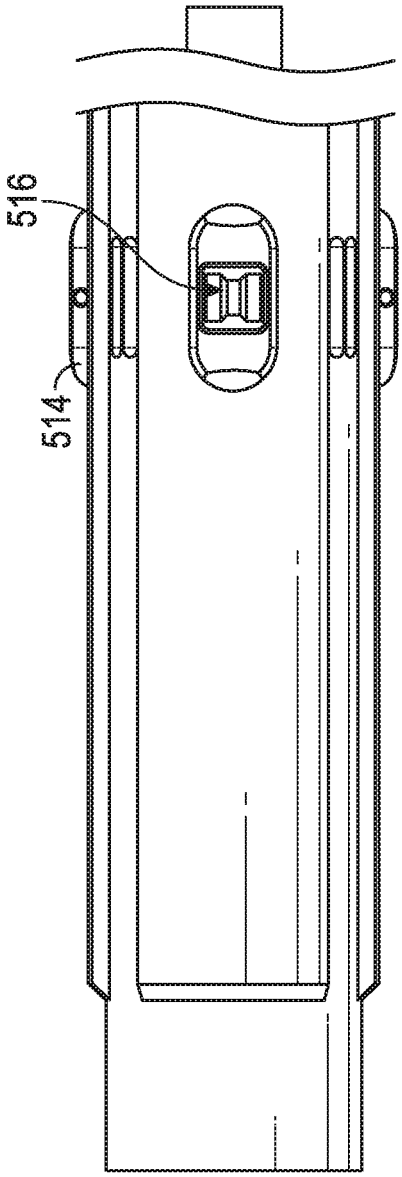

FIGS. 5A-5C are a sectional side view, an isometric side view, and an end view, respectively, of an anchor subsection tool according to some embodiments of this disclosure. Arms 502 are shown in a deployed position. Arms or extendable pads 514 are shown in a retracted position. The anchor subsection, according to some embodiments, may further comprise rollers 516.

According to some embodiments, anchor subsection 500 may include an oil chamber 504, manifold 506, hydraulic pump/motor 508, oil tank 510, electronics driver 512, and battery stave 518. According to some embodiments, the anchor subassembly system may lock the BHA below a swivel by means of a mechanical anchoring system that prevents rotation due to reactive torque, while allowing for freedom of movement in the axial direction. The anchor system may be engaged and disengaged according to some embodiments through a combination of rotation, vibration, and/or axial force. According to some embodiments, surface telemetry signals may be made available to electronics within the anchor subassembly, including electromagnetic, mud pulse telemetry, and rotary speed combinations.

According to some embodiments, a clutch system may be provided to allow rotation of the drill string above the anchored BHA. The clutch maintains rotation and hydraulic integrity of the drill string to the bottom of the BHA, as well as an axial connection to the top of the BHA. According to some embodiments, the clutch system can be engaged and disengaged without limit using rotational and/or axial force, or vibrations.

According to some embodiments, preventing the BHA from rotation while allowing it to move axially creates the ability to hold the drill bit toolface constant in order to directionally steer the BHA, for example for drilling new wellbore or sidetracking an additional wellbore. According to some embodiments, allowing the drill string above the clutch to rotate improves general hole cleaning and increases the axial force up and down on the top of the anchored BHA, while the anchored BHA is non-rotating.

Figure 6A:
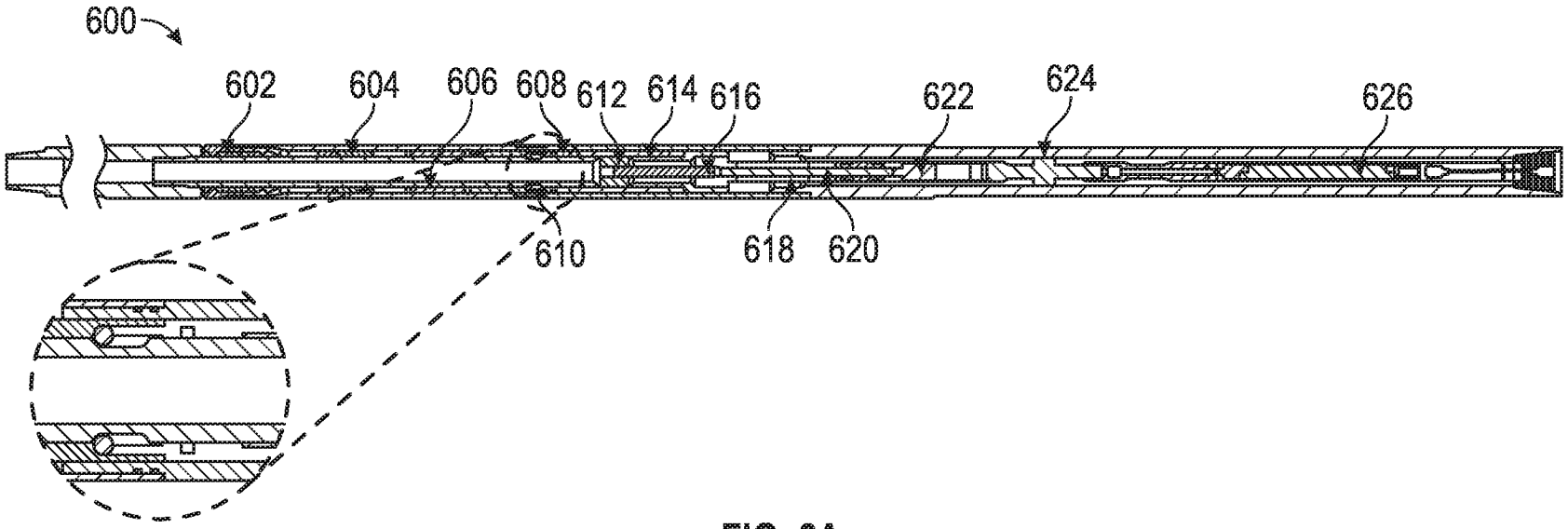
FIGS. 6A and 6B are sectional side views of a drill string including a downhole clutch tool according to some embodiments of this disclosure.
Figure 6B:
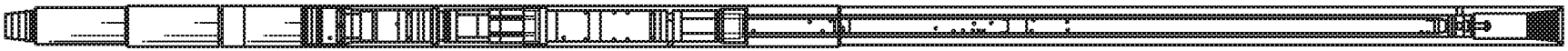

FIGS. 6A and 6B are sectional side views of a downhole clutch subassembly 600 in "locked" mode according to some embodiments of this disclosure. According to some embodiments, subassembly 600 may include bearings at locations 602, 606, 608, and 614. According to some embodiments, subassembly 600 may further include compensation piston 604. At location 610 according to some embodiments, shifting balls or "keys" may be used to engage and lock the clutch for rotation.

According to various embodiments, subassembly 600 may further include shifting sleeve 612 and 616 for engaging and disengaging the clutch assembly. According to some embodiments, lead screw nut 618 and lead screw 620 may be manipulated using motor 622 to engage the clutch mechanism. Location 624 shows the clutch subassembly locked in position. According to some embodiments, subassembly 600 may include an electronics and battery section 626. FIG. 6B according to some embodiments, shows example dimensions of a downhole clutch subassembly.

A downhole clutch tool according to some embodiments may include two tubular members that are axially fastened to one another but are free to rotate freely with respect to each other. According to some embodiments, A sleeve shaped component with keys or a spline feature can be moved into a position that locks the two tubular members together or held in a position where they are unlocked and free to rotate. According to some embodiments, the sleeve component is moved axially by a linear drive system that is powered by an electric motor, connected to an electronics section and a battery.

According to some embodiments, the two tubular members may contain a section arranged such that one tubular section is nested, or contained, within the other. According to some embodiments, this configuration allows length (typically 12-36 inches) for radial and axial bearings and for seals. The seals are present to ensure that the drilling fluid on the inside of the tubular members does not leak to the outside. Some embodiments may also include an oil filled section in a space that is radially between the two members. The oil filled section is present in order to lubricate the movement of the engagement keys or splines with respect to each other.

Sleeve Component

According to some embodiments, the sleeve component may comprise a hollow cylinder of approximately 5 inches overall length. The sleeve is machined with spline teeth on its outer surface for constant engagement with the inner surface of the outer tubular member. The inside of the sleeve is configured to accept keys (or in this case, ball bearings that act as keys). According to some embodiments, the device is configured such that in one axial position the keys (or balls) will engage with a mating profile on the outer surface of the inner tubular and prevent relative rotation. In another axial position the keys (or balls) will be out of alignment with that profile and there will be no torque transferred between the bodies. In that case the bodies are allowed to spin freely with respect to each other.

Linear Drive System

A linear drive module according to some embodiments contains a ball screw or other linear drive mechanism, an electric motor, a battery, a motor driver circuit, and a sensor and MPU circuit. The MPU/Sensor circuit monitors the vibration or rotational status of the tool and then uses that input to make a determination about when to send a signal to activate the motor. The motor driver circuit takes power from the battery and turns the motor a measured number of turns to extend the linear drive to a position congruent with the instruction from the MPU.

Sensor

According to some embodiments, a positional or environmental sensor may comprise accelerometers and magnetometers that are configured to detect the level of vibration and/or rotation of the tool. Vibration level is correlated with mud flow rate, so varying or cycling the mud flow rate at certain measured intervals can be used as a means of encoding information. Measuring the time between vibration events in the downhole tool can be used as a means of decoding that same information. Alternatively, information can be encoded in time intervals between rotation events of the drill string. By measuring and filtering the rotation status over time that information can be decoded.

Communications with the Downhole Clutch Tool

According to some embodiments, a mode of communication with the tool will be via changes to rotation. By measuring the oscillations in the magnitude of the lateral magnetometers and/or accelerometers a determination about the rotational state of the tool can be made. For instance, if there is a primary frequency to the fluctuations of all 4 sensors that is equivalent, is above a certain threshold, and is between 0.1 Hz and 3 Hz then we can say that the tool is rotating. If the drill string is rotated for an exact period of time (plus or minus a small margin), then stopped for an exact period of time, and then started again after a measured but variable amount of time, data can be encoded into the amount of time that has elapsed since the first stoppage in rotation. So as an example:

1. The Drill string is held still for greater than 2 minutes.
2. Rotation is turned on for between 25 and 35 seconds.
3. Rotation is stopped.
4. Rotation begins again between 25 and 35 seconds later (for position 1) or
5. Rotation begins again between 55 and 65 seconds later (for position 2).

According to some embodiments, vibration sensing, where the overall value of the measurement of the accelerometers is used, may also be used for this type of data downlink. In that case an example of a downlink sequence might be:

1. The pumps are turned off for greater than 2 minutes.
2. The pumps are turned on for between 25 and 35 seconds.
3. Pumps are turned off.
4. Pumps begin again between 25 and 35 seconds later (for position 1) or
5. Pumps begin again between 55 and 65 seconds later (for position 2).

The preceding sequences are examples only. The exact timing and tolerance bands for each time sequence may be adjusted depending on depth and other factors regarding the drilling process.

According to some embodiments, the electronics can be configured such that movement to the sleeve component is carried out only when the tool senses that no vibration is present. In this way, excess stress on the splines or keys that would be caused by mating or de-mating while under torque can be avoided.

Figure 7:
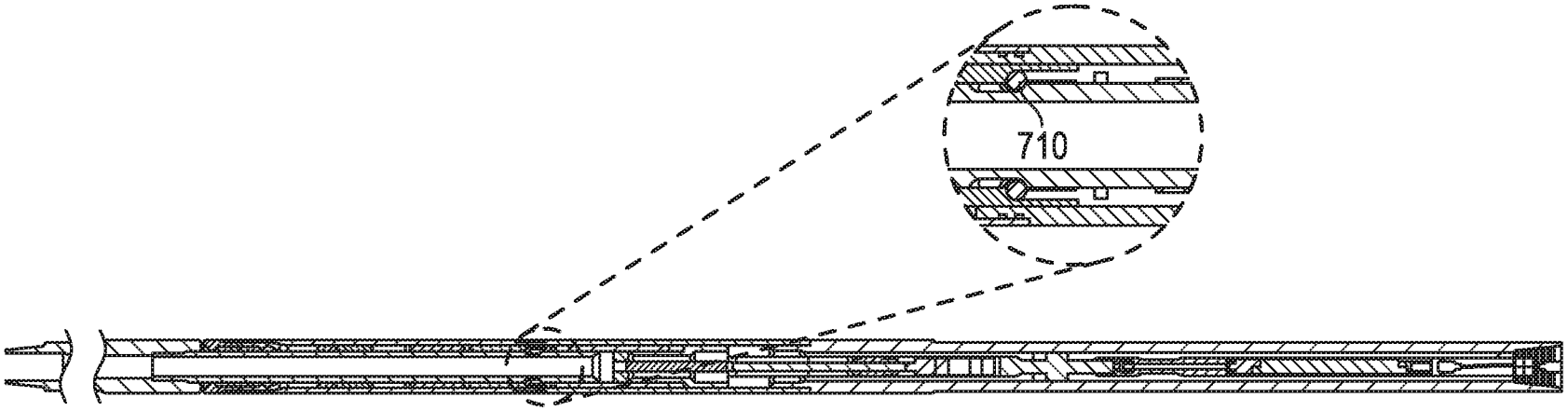
FIG. 7 is a sectional side view of a downhole clutch tool according to some embodiments of this disclosure.

FIG. 7 is a sectional side view of a downhole clutch tool in free spinning mode according to some embodiments of this disclosure. At section 710, shifting balls are disengaged, in "rotating mode," as contrasted to the locked mode shown at section 610 of FIG. 6.

Figure 8A:
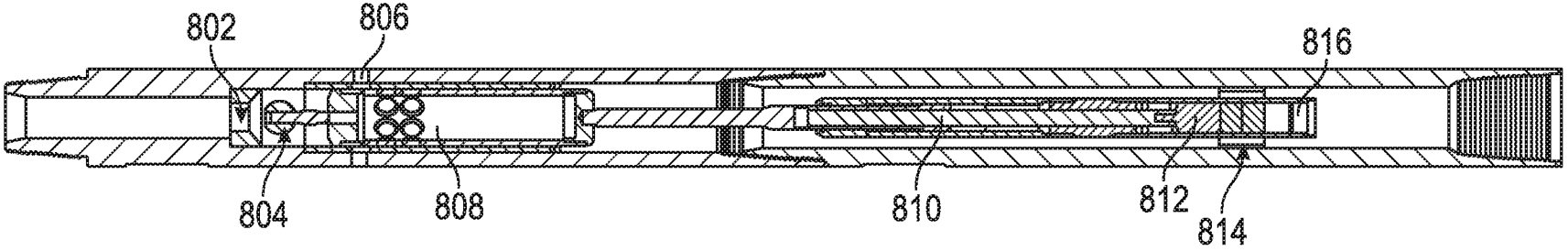
FIGS. 8A and 8B are side sectional views of a circulating subsection tool according to some embodiments of this disclosure.
Figure 8B:
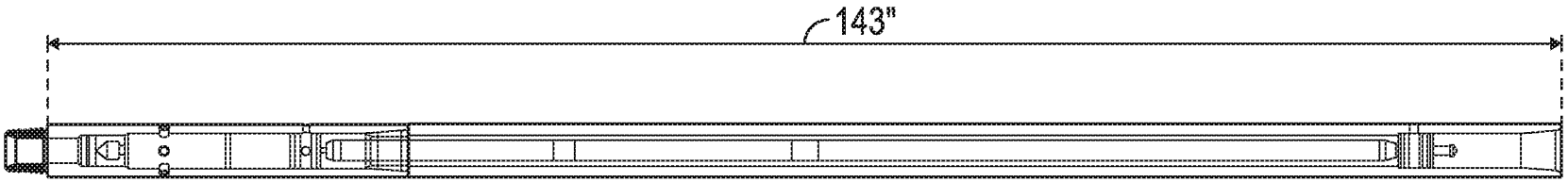

FIGS. 8A and 8B are side sectional views of a circulating subsection tool according to some embodiments of this disclosure. According to some embodiments, an example circulating subsection tool includes valve seat 802 and valve ball 804 for blocking or allowing flow through a bottom aperture of the subsection. According to some embodiments, one or more apertures or openings in the side of the body are located in the area shown at 806. The apertures, when unblocked, allow the flow of fluid to the exterior of the tool into the wellbore or annulus.

According to some embodiments, internal sleeve 808 is positioned within the body of the circulating subsection in part to block or unblock apertures 806. According to some embodiments, linear actuator 810 and electric motor may be used to move internal sleeve 808 into the desired position.

According to some embodiments, attachment 814 is provided to affix electric motor 812 to the device body, and attachment 816 is provided for attaching other elements such as a sensor, MPU, and batteries of the example embodiment.

According to some embodiments, a downhole operable circulating sub may include two principal components: the valve body module and the linear drive module. According to some embodiments, the valve body effects changes to the fluid flow and the linear drive module positions the valve body.

Valve Body Module

The valve body module consists of a sleeve attached on one side to the linear drive and on the other side to a poppet or ball shape. The sleeve and poppet assembly move axially inside of the tool to one of three positions, shown below at FIGS. 9A-9C.

Position 1: The solid section of the sleeve and the holes on the side of the sub body are aligned so that the sleeve is sealing the holes in the sub body. The poppet is not engaged with its seat. Mud flows axially through the tool.

Position 2: The solid section of the sleeve and the holes in the body are now misaligned so that mud is permitted to flow out through the side of the tool. The poppet is not engaged with its seat. Mud flows axially through the tool and some of the flow stream exits the side ports.

Position 3: The solid section of the sleeve is still misaligned with the holes on the body so that mud flows out through the side of the tool. The poppet is now engaged with its seat so that axial flow is now blocked and all of the mud flow is forced out the side.

Linear Drive Module

According to some embodiments, the linear drive module contains a ball screw or other linear drive mechanism, an electric motor, a battery, a motor driver circuit, and a sensor and MPU circuit. The MPU/Sensor circuit monitors the vibration or rotational status of the tool and then uses that input to make a determination about when to send a signal to activate the motor. The motor driver circuit takes power from the battery and turns the motor a measured number of turns to extend the linear drive to a position congruent with the instruction from the MPU.

Sensor

The positional or environmental sensor according to some embodiments may include accelerometers and magnetometers that are configured to detect the level of vibration and/or rotation of the tool. Vibration level may be correlated with mud flow rate, so varying or cycling the mud flow rate at certain measured intervals can be used as a means of encoding information. Measuring the time between vibration events in the downhole tool can be used as a means of decoding that same information. Alternatively, information can be encoded in time intervals between rotation events of the drill string. By measuring and filtering the rotation status over time that information can be decoded.

Communications with the Circulating Sub

According to some embodiments, a mode of communication with the tool will be via changes to rotation. By measuring the oscillations in the magnitude of the lateral magnetometers and/or accelerometers a determination about the rotational state of the tool can be made. For instance, if there is a primary frequency to the fluctuations of all 4 sensors that is equivalent, is above a certain threshold, and is between 0.1 Hz and 3 Hz then we can say that the tool is rotating. If the drill string is rotated for an exact period of time (plus or minus a small margin), then stopped for an exact period of time, and then started again after a measured but variable amount of time, data can be encoded into the amount of time that has elapsed since the first stoppage in rotation. As one example:

1. The Drill string is held still for greater than 2 minutes.
2. Rotation is turned on for between 25 and 35 seconds.
3. Rotation is stopped.
4. Rotation begins again between 25 and 35 seconds later (for mode 1) or
5. Rotation begins again between 55 and 65 seconds later (for mode 2) or
6. Rotation begins again between 85 and 95 seconds later (for mode 3).

According to some embodiments, vibration sensing, where the overall value of the measurement of the accelerometers is used, may also be used for this type of data downlink. In that case an example of a downlink sequence might be:

1. The pumps are turned off for greater than 2 minutes.
2. The pumps are turned on for between 25 and 35 seconds.
3. Pumps are turned off.
4. Pumps begin again between 25 and 35 seconds later (for mode 1) or
5. Pumps begin again between 55 and 65 seconds later (for mode 2) or
6. Pumps begin again between 85 and 95 seconds later (for mode 3).

The preceding sequences are examples only. The exact timing and tolerance bands for each time sequence may be adjusted depending on depth and other factors regarding the drilling process.

According to some embodiments, the electronics can be configured such that movement to the valve body is carried out only when the tool senses that no flow is present. In this way, excess stress on the sealing elements can be avoided.

FIG. 8B is provided to show dimensions of an example embodiment of a circulating subsection tool according to some embodiments of this disclosure.

Figure 9A:
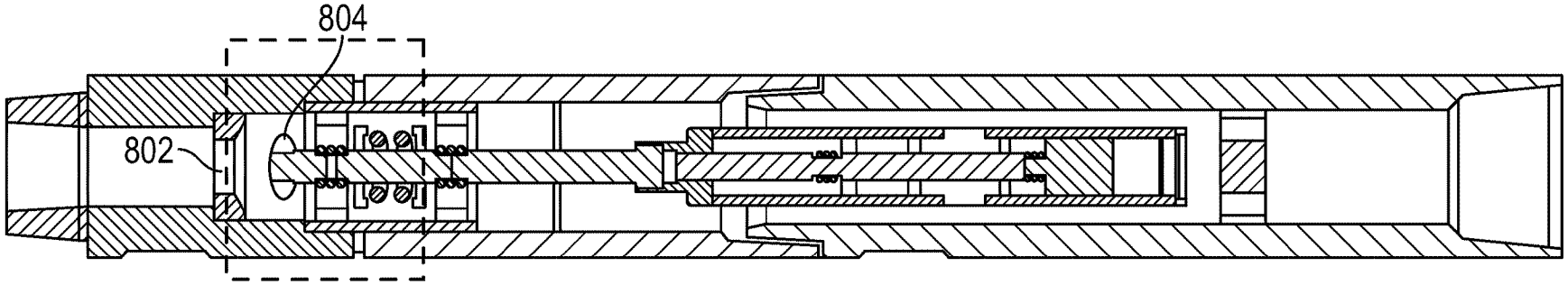
FIGS. 9A-9C are side sectional views of a circulating subsection tool in various modes of operation, according to some embodiments of this disclosure.
Figure 9B:
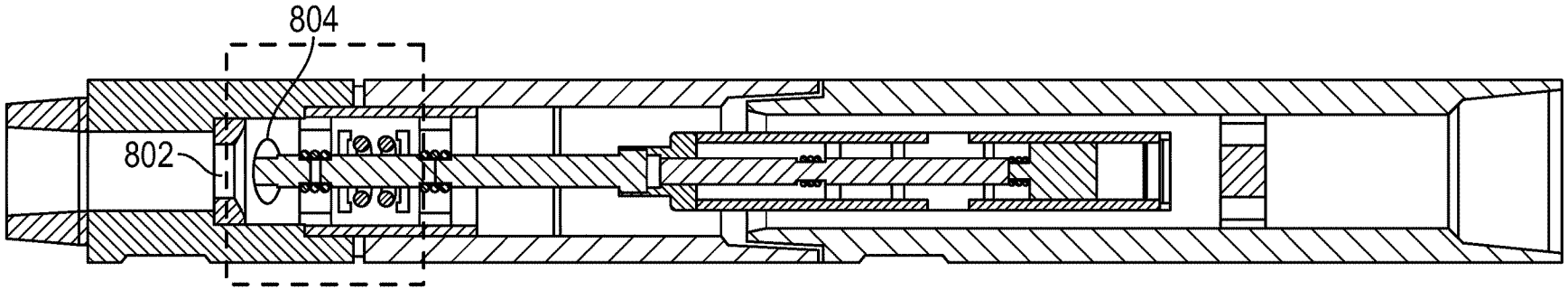
Figure 9C:
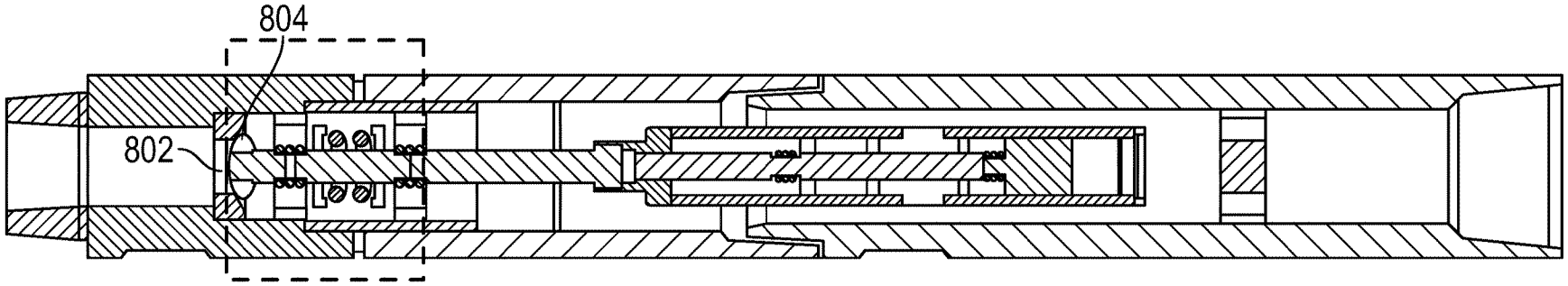

FIGS. 9A-9C are side sectional views of a circulating subsection tool in various modes of operation, according to some embodiments of this disclosure. FIG. 9A according to some embodiments shows a first operational mode in which the ball is valve open and the apertures to the annulus closed.

FIG. 9B according to some embodiments shows a second operational mode in which both the ball valve and the apertures are open, allowing fluid to flow through the bottom opening as well as through the apertures into the annulus.

FIG. 9C according to some embodiments shows a third operational mode in which the ball valve is closed, preventing flow to the motor through the bottom opening of the tool, while the apertures are open, allowing fluid to flow out of the circulating subsection tool into the annulus.

None of the descriptions in this application should be read as implying that any particular element, step, or function is an essential element that must be included in the claim scope. The scope of patented subject matter is defined only by the claims. Moreover, none of the claims is intended to invoke 35 U.S.C. 112(f) unless the exact words "means for" are followed by a participle.

What is claimed is:

1. A method of operating a drill string within a well, the method comprising:

receiving data from one or more sensors of the drill string, the data representing an analog control command sequence comprising a predetermined sequence of rotational inputs to the drill string;

analyzing the analog control command sequence;

determining that the control command sequence represents a command to change an operational mode of the drill string from a first operational mode to a second operational mode; and transmitting a signal to an actuator of the drill string, the signal representing an electronic command to activate the actuator in such a way as to change the drill string from the first operational mode to the second operational mode.

2. The method of claim 1, wherein the analog control sequence further comprises a predetermined sequence of vibrational inputs to the drill string.

3. The method of claim 2, wherein the predetermined sequence of vibrational inputs comprises actuations of at least one pump associated with the downhole device.

4. The method of claim 1, wherein the drill string further comprises:

a substantially cylindrical body comprising a plurality of segments; and an anchoring subassembly segment comprising one or more retractable anchors; wherein:

the actuator comprises an electronic driver that, when the drill string is in the second operational mode, activates an internal mechanism of the anchoring subassembly to force the retractable anchors outward to contact a wall of the well such that rotational motion of the anchoring subassembly is inhibited while axial movement of the anchoring subassembly segment is not prevented.

5. The method of claim 4, wherein a clutch assembly is configured to allow for rotation of the drill string above the anchoring subassembly when the drill string is in the second operational mode.

6. The method of claim 1, wherein the drill string further comprises:

a first and second tubular member, the first and second tubular members at least partially nested within each other and each of the first and second tubular members having a threaded connection at its distal end; and an axially moveable cylindrical sleeve disposed laterally between the first and second tubular members; wherein:

the cylindrical sleeve is rotationally coupled to the first tubular member; the actuator comprises an electric motor configured to cause axial movement of the cylindrical sleeve when activated;

when the drill string is in the first operational mode, the cylindrical sleeve is rotationally coupled to the second tubular member; and when the drill string is in the second operational mode, the cylindrical sleeve is rotationally decoupled from the second tubular member.

7. The method of claim 1, wherein the drill string further comprises: a substantially cylindrical body comprising a plurality of segments;

a circulating subassembly segment comprising a bottom aperture at the distal end of the circulating subassembly and one or more annulus apertures in a side wall of the circulating subassembly; and a hollow cylindrical sleeve positioned within the circulating subassembly; wherein: the actuator comprises an electric motor configured to cause axial movement of the cylindrical sleeve when activated;

when the drill string is in the first operational mode, the cylindrical sleeve is positioned such that the one or more annulus apertures are blocked and a fluid may flow through the bottom aperture, which is not blocked; and when the drill string is in the second operational mode, the cylindrical sleeve is positioned such that the fluid may flow through both the one or more annulus apertures and the bottom aperture.

8. The method of claim 7, further comprising a third operational mode of the drill string, wherein a ball valve is configured to inhibit the fluid from flowing through the bottom aperture while the cylindrical sleeve is positioned to allow the fluid to flow through the one or more annulus apertures.

9. A system comprising:

a drill string; and one or more hardware processors configured by machine-readable instructions to: receive data from one or more sensors of the drill string, the data representing an analog control sequence comprising a predetermined sequence of vibrational inputs to the drill string including actuations of at least one pump associated with the downhole device;

analyze the analog control sequence;

determine that the analog control sequence represents a command to change an operational mode of the drill string from a first operational mode to a second operational mode; and transmit a signal to an actuator of the drill string, the signal representing an electronic command to activate the actuator in such a way as to change the drill string from the first operational mode to the second operational mode.

10. The system of claim 9, wherein the analog control sequence further comprises a predetermined sequence of rotational inputs to the drill string.

11. The system of claim 9, wherein the drill string further comprises:

a substantially cylindrical body comprising a plurality of segments; and an anchoring subassembly segment comprising one or more retractable anchors; wherein:

the actuator comprises an electronic driver that, when the drill string is in the second operational mode, activates an internal mechanism of the drill string to force the retractable anchors of the anchoring subassembly outward to contact a wall of the well such that rotational motion of the anchoring subassembly is inhibited while axial movement of the anchoring subassembly segment is not prevented.

12. The system of claim 11, further comprising a clutch assembly configured to allow for rotation of the drill string above the anchoring subassembly when the drill string is in the second operational mode.

13. The system of claim 9, wherein the drill string further comprises:

a first and second tubular member, the first and second tubular members at least partially nested within each other and each of the first and second tubular members having a threaded connection at its distal end; and an axially moveable cylindrical sleeve disposed laterally between the first and second tubular members; wherein:

the cylindrical sleeve is rotationally coupled to the first tubular member; the actuator comprises an electric motor configured to cause axial movement of the cylindrical sleeve when activated;

when the drill string is in the first operational mode, the cylindrical sleeve is rotationally coupled to the second tubular member; and when the drill string is in the second operational mode, the cylindrical sleeve is rotationally decoupled from the second tubular member.

14. The system of claim 9, wherein the drill string further comprises: a substantially cylindrical body comprising a plurality of segments;

a circulating subassembly segment comprising a bottom aperture at the distal end of the circulating subassembly and one or more annulus apertures in the side wall of the circulating subassembly; and a hollow cylindrical sleeve positioned within the circulating subassembly; wherein: the actuator comprises an electric motor configured to cause axial movement of the cylindrical sleeve when activated;

when the drill string is in the first operational mode, the cylindrical sleeve is positioned such that the one or more annulus apertures are blocked and a fluid may flow through the bottom aperture, which is not blocked; and when the drill string is in the second operational mode, the cylindrical sleeve is positioned such that the fluid may flow through both the one or more annulus apertures and the bottom aperture.

15. The system of claim 14, further comprising a third operational mode of the drill string, wherein a ball valve is configured to inhibit the fluid from flowing through the bottom aperture while the cylindrical sleeve is positioned to allow the fluid to flow through the one or more annulus apertures.

16. An anchoring subassembly of a drill string within a well, the anchoring subassembly comprising:

one or more retractable anchors positioned about an axis of the anchor subassembly, the retractable anchors having a radially extended position and a radially retracted position;

an actuator segment comprising an electronic driver configured to radially move the retractable anchors between the radially extended position and the radially retracted position; and an electronic control module configured to receive data from one or more sensors of the drill string, the data representing an analog control sequence including a predetermined sequence of rotational inputs to the drill string, the electronic control module further configured to:

determine that the control command sequence represents a command to change an operational mode of the drill string from a first operational mode to a second operational mode or from the second operational mode to the first operational mode, the first operational mode associated with the radially retracted position of the retractable anchors and the second operational mode associated with the radially extended position of the retractable anchors; and transmit a signal to the actuator of the drill string, the signal representing an electronic command to move the retractable anchors into the radially extended position or into the radially retracted position according to the particular operational mode indicated by the analog control sequence, such that when the drill string is in the second operational mode, the retractable anchors contact the well bore such that rotational motion of the anchoring subassembly is inhibited while axial movement of the anchoring subassembly is not prevented.

17. The anchoring subassembly of claim 16, wherein the analog control sequence further comprises a predetermined sequence of vibrational inputs to the drill string, the predetermined sequence of vibrational inputs comprising actuations of at least one pump associated with the downhole device.

18. A clutch subassembly of a drill string within a well, the clutch assembly comprising:

at least a first tubular member and a second tubular member, the first and second tubular members at least partially nested within each other and each of the first and second tubular members having a threaded connection at its distal end;

an axially moveable cylindrical sleeve disposed laterally between the first and second tubular members, the cylindrical sleeve rotationally coupled to the first tubular member, the cylindrical sleeve having an engaged position wherein the cylindrical sleeve is rotationally coupled to the second tubular member, the cylindrical sleeve also having a disengaged position wherein the cylindrical sleeve is rotationally disengaged from the second tubular member;

an actuator comprising an electric motor configured to cause axial movement of the cylindrical sleeve when activated;

an electronic control module configured to receive data from one or more sensors of the drill string, the data representing an analog control command sequence, the electronic control module further configured to:

determine that the control command sequence represents a command to change an operational mode of the drill string from a first operational mode to a second operational mode or from the second operational mode to the first operational mode, the first operational mode associated with the engaged position of the cylindrical sleeve and the second operational mode associated with the disengaged position of the cylindrical sleeve;

transmit a signal to the actuator of the drill string, the signal representing an electronic command to activate an actuator in such a way as to move the cylindrical sleeve into the engaged or disengaged position according to the particular operational mode indicated by the control command sequence.

19. The clutch subassembly of claim 18, wherein the analog control sequence comprises a predetermined sequence of rotational inputs to the drill string.

20. The clutch subassembly of claim 18, wherein the analog control sequence comprises a predetermined sequence of vibrational inputs to the drill string, the predetermined sequence of vibrational inputs comprising actuations of at least one pump associated with the downhole device.

21. A circulating subassembly of a drill string within a well, the circulating subassembly comprising:

at least one bottom aperture at or near a distal end of the circulating subassembly; a ball valve having an engaged position wherein the ball valve is configured to inhibit a fluid from flowing through the at least one bottom aperture, the ball valve further having a disengaged position wherein the ball valve is configured to allow the fluid to flow through the at least one bottom aperture;

one or more annulus apertures in a side wall of the circulating subassembly; a hollow cylindrical sleeve positioned within the circulating subassembly, the cylindrical sleeve having an engaged position wherein the cylindrical sleeve is configured to allow fluid to flow through the one or more annulus apertures, the cylindrical sleeve further having a disengaged position wherein the cylindrical sleeve is configured to inhibit fluid from flowing through the one or more annulus apertures;

a ball valve actuator comprising an electronic drive configured to move the ball valve between its engaged and disengaged positions;

a sleeve actuator comprising an electronic driver configured to move the cylindrical sleeve between its engaged and disengaged positions;

an electronic control module configured to receive data from one or more sensors of the drill string, the data representing an analog control command sequence, the electronic control module further configured to:

determine that the control command sequence represents a command to change an operational mode of the drill string to a first, second, or third operational mode, the first operational mode representing both the ball valve and the cylindrical sleeve in their respective disengaged positions, the second operational mode representing the ball valve in its disengaged position while the cylindrical sleeve is in its engaged position, the third operational mode representing both the ball valve and the cylindrical sleeve in their respective engaged positions; and transmit one or more signals to the ball valve actuator and the cylindrical sleeve actuator, the one or more signals representing electronic commands to move the ball valve and the cylindrical sleeve into their proper positions according to the particular operational mode indicated by the control command sequence.

22. The circulating subassembly of claim 21, wherein the analog control sequence comprises a predetermined sequence of rotational inputs to the drill string.

23. The circulating subassembly of claim 21, wherein the analog control sequence comprises a predetermined sequence of vibrational inputs to the drill string, the predetermined sequence of vibrational inputs comprising actuations of at least one pump associated with the downhole device.

* * * * *